United States Patent [19]

Nao et al.

[11] Patent Number: 4,487,306

[45] Date of Patent: Dec. 11, 1984

[54] BILL-DISCRIMINATING APPARATUS

[75] Inventors: Manabu Nao, Ebina; Mitsuru Takayasu, Tama; Shyuetsu Oikawa, Kawasaki, all of Japan

[73] Assignee: Fujitsu Limited, Kawasaki, Japan

[21] Appl. No.: 400,014

[22] Filed: Jul. 20, 1982

[30] Foreign Application Priority Data

Jul. 24, 1981 [JP] Japan ..... 56-116089

[51] Int. Cl.[3] ..... G07F 7/04

[52] U.S. Cl. ..... 194/4 C; 382/7

[58] Field of Search ..... 194/4 R, 4 C, 4 E; 209/534; 382/7

[56] References Cited

U.S. PATENT DOCUMENTS

| | | | |
|---|---|---|---|
| 3,496,371 | 2/1970 | Endo | 382/7 X |
| 4,041,456 | 8/1977 | Ott et al. . | |
| 4,163,157 | 7/1979 | Guignard . | |
| 4,179,685 | 12/1979 | O'Maley | 382/7 |
| 4,348,656 | 9/1982 | Gorgone et al. | 382/7 X |
| 4,349,111 | 9/1982 | Shah et al. | 209/534 |

FOREIGN PATENT DOCUMENTS

| | | |
|---|---|---|
| 12723 | 3/1980 | European Pat. Off. . |
| 2938585 | 5/1980 | Fed. Rep. of Germany . |
| 8101211 | 4/1981 | Int. Pat. Institute . |
| 2046488 | 11/1980 | United Kingdom . |
| 2047209 | 11/1980 | United Kingdom . |
| 2056415 | 3/1981 | United Kingdom . |

*Primary Examiner*—Stanley H. Tollberg
*Attorney, Agent, or Firm*—Staas & Halsey

[57] ABSTRACT

A bill-discriminating apparatus which is used, for example, in an automatic deposit machine and which discriminates a bill by comparing patterns read from the bill with standard patterns. The apparatus includes a circuit for reading patterns from a conveyed bill, one or more sensors for determining the conveyance condition of the bill, a circuit for generating standard patterns corresponding to the conveyance condition of the bill and/or to the kind of bill, and a circuit for comparing the patterns, read from the bill by the circuit for reading patterns, with the standard patterns, thereby discriminating the truth of falsity of the bill and/or the kind of bill.

8 Claims, 25 Drawing Figures

Fig. 12A

ZONE →

X → y ↕

| TRACK \ ZONE | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | 0 | 1 | 1 | 1 | 1 | 0 | 0 | 0 | 0 | 1 | 1 | 1 | 0 | 0 | 1 |
| 2 | 0 | 1 | 1 | 1 | 1 | 0 | 0 | 0 | 0 | 0 | 1 | 1 | 1 | 1 | 0 |
| 3 | 0 | 0 | 1 | 0 | 0 | 0 | 1 | 1 | 1 | 1 | 1 | 1 | 1 | 1 | 0 |
| 4 | 1 | 1 | 0 | 1 | 0 | 0 | 0 | 0 | 0 | 0 | 1 | 1 | 1 | 0 | 1 |
| 5 | 0 | 1 | 1 | 1 | 0 | 0 | 1 | 0 | 1 | 0 | 0 | 0 | 0 | 0 | 1 |
| 6 | 0 | 1 | 1 | 1 | 0 | 0 | 0 | 0 | 0 | 0 | 0 | 0 | 0 | 1 | 1 |
| 7 | 0 | 1 | 0 | 0 | 1 | 0 | 0 | 1 | 1 | 1 | | | | | |
| 8 | 0 | 0 | 1 | 0 | 1 | | | | | | 1 | 0 | 1 | 0 | 0 |
| 9 | | | | | | 1 | 1 | 0 | 0 | 1 | 1 | 1 | 1 | 0 | 0 |
| 10 | 0 | 1 | 0 | 0 | 1 | 0 | 0 | 1 | 0 | 0 | 0 | 0 | 1 | 1 | 0 |

f

Fig. 12B

ZONE →

X → y ↕

| TRACK \ ZONE | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | 1 | 1 | 1 | 0 | 0 | 0 | 1 | 1 | 0 | 1 | 0 | 1 | 1 | 1 | 0 |
| 2 | 1 | 1 | 0 | 0 | 1 | 1 | 0 | 1 | 0 | 0 | 0 | 1 | 1 | 0 | 1 |
| 3 | 1 | 1 | 0 | 0 | 1 | 1 | 0 | 0 | 1 | 1 | 0 | 0 | 0 | 1 | 1 |
| 4 | 1 | 1 | 0 | 1 | 1 | 1 | 0 | 0 | 0 | 0 | 1 | 0 | 0 | 0 | 1 |
| 5 | 0 | 1 | 1 | 1 | 0 | 0 | 1 | 0 | 1 | 0 | 0 | 0 | 0 | 0 | 1 |
| 6 | 0 | 0 | 0 | 0 | 0 | 0 | 0 | 1 | 1 | 1 | 0 | 1 | 1 | 0 | 1 |
| 7 | 0 | 0 | 1 | 1 | 0 | 0 | 0 | 1 | 0 | 1 | | | | | |
| 8 | 1 | 0 | 0 | 1 | 0 | | | | | | 1 | 1 | 1 | 1 | 1 |
| 9 | | | | | | 0 | 0 | 1 | 0 | 1 | 1 | 1 | 0 | 0 | 1 |
| 10 | 1 | 1 | 0 | 0 | 0 | 1 | 1 | 0 | 0 | 0 | 0 | 1 | 1 | 0 | 1 |

f

BILL-DISCRIMINATING APPARATUS

BACKGROUND OF THE INVENTION (1) Field of the Invention

The present invention relates to a bill-discriminating apparatus in a bill processing system such as an automatic depositing machine which discriminates a plurality of bills that are fed thereinto collectively and which executes processing depending upon the discriminated results. According to the present invention, the bills can be discriminated with an increased accuracy and at a high speed.

(2) Description of the Prior Art

In a conventional bill-discriminating apparatus used, for example, in an automatic depositing machine, a bill is conveyed along a passage along which is arranged one or more discriminating sensors. The passage comprises guides on both sides thereof so that narrow gaps are defined by the guides and the bill being conveyed and so that the bill will not tilt or deviate sideways, thereby constantly maintaining the position of the predetermined pattern region of the bill that is read by the descriminating sensors. Allowance, however, must be made for a small degree of deviation. To effect discrimination in spite of the presence of a small degree of deviation, therefore, the bill must be discriminated by utilizing regions of relatively simple patterns. Therefore, it is difficult to carry out discrimination with a high accuracy, and discrimination is often erroneously rendered depending upon the damage of or contamination of the bill. In the case of small size bills, furthermore, it is difficult to completely restrict the position of the bills.

If the passage is strictly defined, furthermore, the bill is always conveyed through the same passage no matter how many times the same bill is fed into the apparatus. Therefore, a counterfeit bill can be continually fed until it is accepted by the discriminating portion. Further, if complicated patterns of the bill are discriminated in order to increase the accuracy of discrimination, all of the contents of the reference pattern memory must be read and checked. Therefore, more time is required for the discrimination process.

SUMMARY OF THE INVENTION

It is, therefore, a principal object of the present invention to make it possible to discriminate complex pattern portions of a bill accurately and to rapidly effect high-speed bill processing.

In order to accomplish the above object, the present invention deals with an apparatus for discriminating and processing bills of different denominations through the same processing apparatus by comparing patterns, read by a pattern detecting sensor, from the delivered bills with the reference patterns of normal bills. The apparatus is characterized in that the condition of a bill, when conveyed, is detected by determining the deviation of the bill in the widthwise direction of the passage in the discriminating portion, thus determining the size of the bill and the amount of tilt of the bill relative to the line perpendicular to the running direction of the bill while the bill is being conveyed through the discrimination portion. Reference patterns are sent to addresses that are provided for the reference pattern memories responsive to the zones and tracks of bills of all kinds. Corresponding addresses in the reference pattern memories are selected, based upon the data concerning the condition of the bill being conveyed, to read the data, and the data which is read, is compared with the pattern.

BRIEF DESCRIPTION OF THE DRAWINGS

FIGS. 12A and 12B are format diagrams of information stored in model maps used in the apparatus of FIG. 2;

DESCRIPTION OF THE PREFERRED EMBODIMENT

The present invention will now be explained with reference to the attached drawings.

Figure 1:
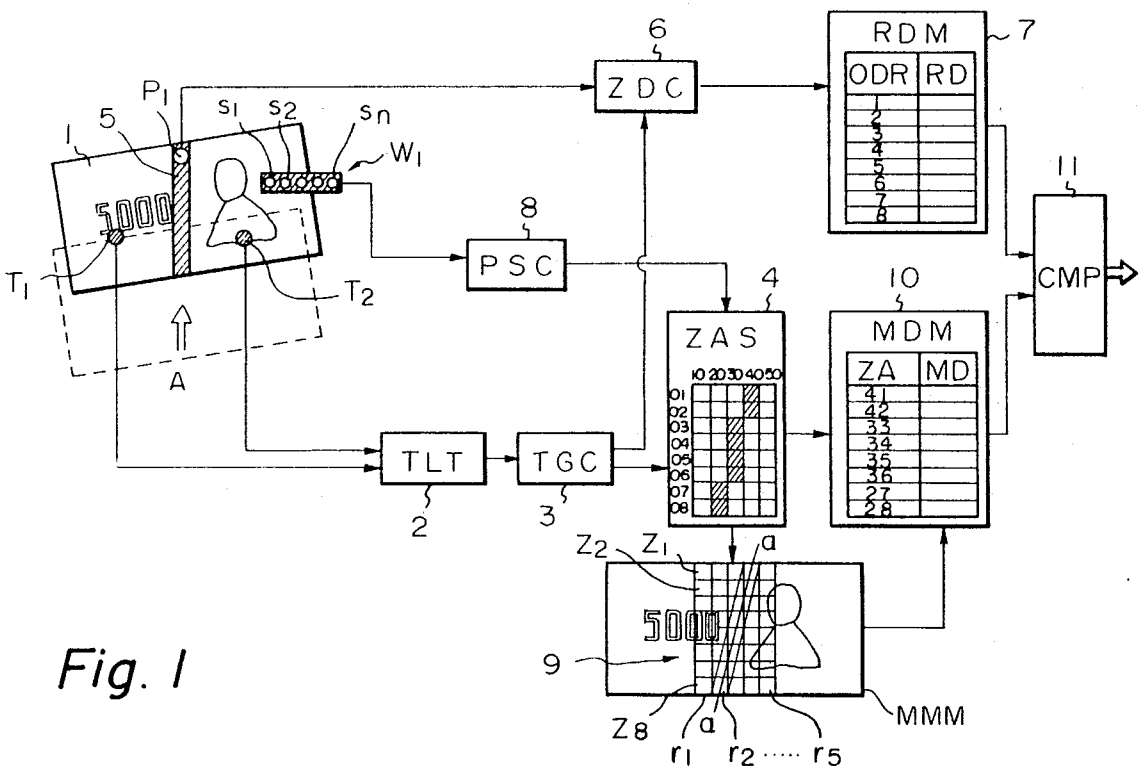
FIG. 1 is a block circuit diagram of the discriminating operation performed by the apparatus according to the present invention.

FIG. 1 is a principle discriminating operation performed by the apparatus according to the present invention. In FIG. 1, bill 1 is conveyed in the direction of arrow A. Amount-of-tilt sensors T1 and T2, i.e., skew sensors, detect the leading edge and the trailing edge of bill 1. Tilt detection circuit 2 detects the amount of tilt of bill 1 from the time interval between the time when one of the sensors T1 and T2 detects the leading edge of bill 1 and the time when the other sensor T1 or T2 detects the leading edge of bill 1. Trigger circuit 3 triggers zone address-selecting circuit 4 and inputs thereto the amount of tilt of bill 1 from tilt detection circuit 2.

Pattern sensor P1 reads the patterns of the hatched track region 5 of bill 1. Zone-dividing circuit 6 is triggered by trigger circuit 3 and divides a continuous pattern signal from pattern sensor P1 into a plurality of zone signals each corresponding to a pattern of one of the zones of track region 5 of bill 1. The zone signals are converted into digital read data RD by an A/D converter (not shown) and digital read data RD is stored in read data memory 7 in the order ODR read by pattern sensor P1.

Position sensor W1 comprises a plurality of sensor elements s1, s2, . . . , sn arranged in a direction perpendicular to the transfer direction of bill 1 shown by arrow A or in one or more lines tilted from the transfer direction of bill 1. Position-sensing circuit 8 receives sensor signals from sensor elements s1, s2, . . . , sn of the position sensor W1 and determines the position of bill 1 in a direction perpendicular to the direction of conveyance of bill 1.

Model map memory 9 stores the standard pattern data of all of the zones of a plurality of adjacent tracks r1, r2, . . . , rm. In the example of FIG. 1, model map memory 9 stores the standard pattern data of five tracks r1, r2, . . . , r5, each track constituting eight zones Z1, Z2, . . . , Z8.

Zone address-selecting circuit 4 generates a series of address data corresponding to the data of the zones of bill 1 traced and sensed by pattern sensor P1 on the basis of the amount-of-tilt data from trigger circuit 3 and the position data from position-sensing circuit 8. According to the address data from zone address-selecting circuit 4, zone data is read out from model map memory 9 and is stored in model data memory 10. For example, if after pattern sensor P1 has traced bill 1 along a slightly tilted line shown by the line a—a, zone address-selecting circuit 4 generates zone addresses ZA corresponding to the zones shown by the hatched squares in the zone address table of zone address-selecting circuit 4. In the zone address table of zone address-selecting circuit 4, numbers 10, 20, 30, 40, and 50 represent track addresses corresponding to track r1, r2, . . . , r5 and numbers 01, 02, . . . , 08 represent zone numbers corresponding to zones Z1, Z2, . . . , Z8.

The zone data read from zone addresses ZA of model map memory 9 is stored in model data memory 10 as model data MD in the order of the zone numbers. Read data RD from read data memory 7 and model data MD from model data memory 10 are compared in comparator circuit 11. If almost all of read data RD and model data MD coincide, bill 1 is regarded as a real bill and if not, bill 1 is regarded as counterfeit.

Figure 2:
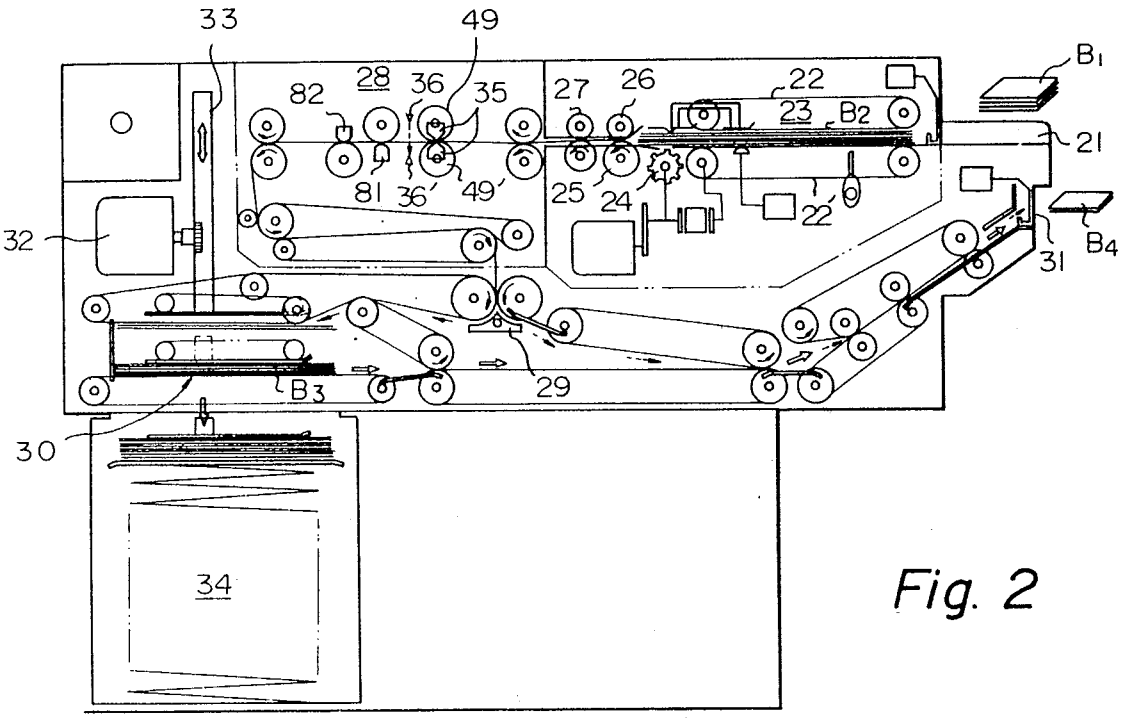
FIG. 2 is a side view of the internal construction of an automatic deposit machine according to the present invention.

FIG. 2 is a side view showing the internal construction of an automatic deposit machine of the type in which bills can be collectively fed. In this machine, the deposit process is carried out in the following way. That is, if a customer collectively feeds a plurality of bills $B_1$ through feed port 21, bills $B_1$ are collectively conveyed to standby portion 23 by belts 22, 22'. Bills $B_1$ are removed one by one from pile $B_2$ under a standby condition by delivery rollers 24, 25 and separation roller 26 and are supplied by conveyor roller 27 to the discriminating portion. After the front and back surface of each bill is discriminated by discriminating sensors 81, 82 in discriminating portion 28, gate 29 operates depending upon the results. If the bill is real, it is guided by gate 29 to a storing portion 30. If it is counterfeit, it is guided by gate 29 to return port 31. The black arrows indicate the path for conveying real bills, and the broken arrows indicate the path for conveying counterfeit bills. When the customer presses the confirmation button, a pusher is lowered by motor 32, and real bills $B_3$ accumulated in the storing portion 30 are conveyed to safe 34 from the storing portion 30. When the customer presses the cancel button, the bills in the storing portion 30 are conveyed collectively to return port 31 through the path indicated by the white arrows and are then conveyed to the customer as denoted by $B_4$.

Figure 3:
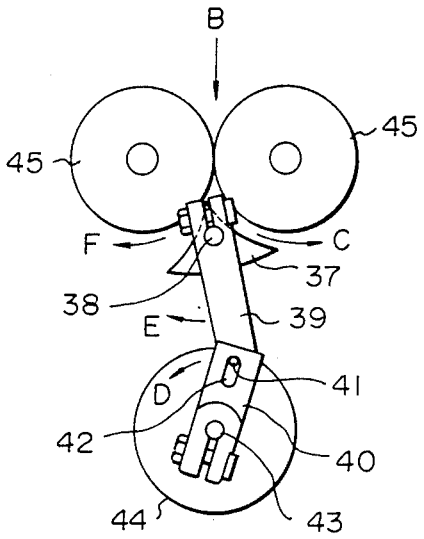
FIG. 3 is a side view of the schematic structure of the gate assembly used in the apparatus of FIG. 2.

FIG. 3 is the structure of gate 29 used in the apparatus of FIG. 2. The gate of FIG. 3 comprises gate member 37 fixed to shaft 38, which is rotated by arm 39. Arm 39 is rotatably connected to arm 40 by pin 41 thereof inserted into the long slot 42 of arm 40. Arm 40 is fixed to the shaft 43 of the rotary plunger 44. Shaft 43 is usually energized in a clockwise direction by, for example, a coil spring (not shown), and when the rotary plunger 44 is not activated, arm 40 and, thus, arm 39 and gate member 37 are located in the positions shown in FIG. 3. Therefore, a bill conveyed from the direction shown by arrow B between guide rollers 45 is conveyed toward the right side in the direction of arrow C and is guided to return port 31 of FIG. 2. When the rotary plunger 44 is activated, arm 40 revolves in a counter clockwise direction as shown by arrow D, and arm 39 and gate member 37 revolve in a clockwise direction as shown by arrow E. Therefore, gate member 37 is located in a position opposite to that shown in FIG. 3 with respect to a line connecting the center of shaft 38 and the center of shaft 43. Therefore, a bill conveyed from the direction shown by arrow B between guide rollers 45 is conveyed toward the left side in the direction of arrow F and is guided to the storing portion 30 of the apparatus of FIG. 2.

Thus, a bill is processed in different ways depending upon the results of discrimination in the discriminating portion 28 of the apparatus of FIG. 2. Operation of the discriminating portion 28 is described below. While a bill is being conveyed by transfer rollers 49, 49', its thickness is determined by thickness sensor 35, comprising of, for example, microswitches, so as to ascertain whether the bills are being conveyed one by one or whether two or more bills are being conveyed together. Then the positions of both the front end and rear end of the bill being conveyed at a predetermined speed are detected by optical sensors 36, 36' (T1 or T2) in order to discriminate the size of the bill and the direction of movement on the basis of the conveyance time. When it is discriminated that the size of the bill is not within the allowable limit, the bill is determined as being counterfeit and is returned to return port 31. If the size appears to be proper, the patterns on the front and back surface are then discriminated by discriminating sensors 81, 82 so as to determine the kind of bill.

Figure 4:
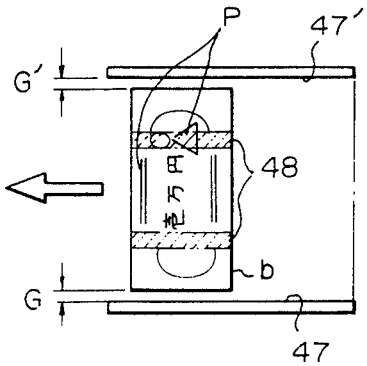
FIG. 4 is a plan view of the bill-discriminating portion used in a conventional bill-discriminating apparatus.

The bill-discriminating portion is usually constructed as shown in FIG. 4, in which narrow gaps G, G' are defined between guides 47, 47' on both sides of the passage and edges of the conveyed bill b so that the bill b will not tilt or will not deviate sideways, thereby constantly maintaining the position of the predetermined region that is read by the discriminating sensors. Allowance, however, must be made for a small degree of deviation. To effect discrimination in spite of a small degree of deviation, therefore, the patterns of the bill must be discriminated by utilizing regions of relatively simple patterns P. Therefore, it is difficult to carry out discrimination with a high accuracy, and discrimination is often erroneously rendered depending upon the degree of damage to or contamination of the bill. In the case of small size bills, furthermore, it is difficult to accurately restrict the position. Hatched regions 48 of bill b are scanned and read by discriminating sensors 81, 82.

If the passage is strictly defined, furthermore, the bill always runs through the same passage no matter how many times it is fed. Therefore, a counterfeit bill can be continually fed until it is accepted by the discriminating portion. Further, if complicated patterns P of bill b are discriminated in order to increase the accuracy of discrimination, all of the contents of the reference pattern memory must be read and discriminated. Therefore, more time is required for the discrimination process.

Figure 5:
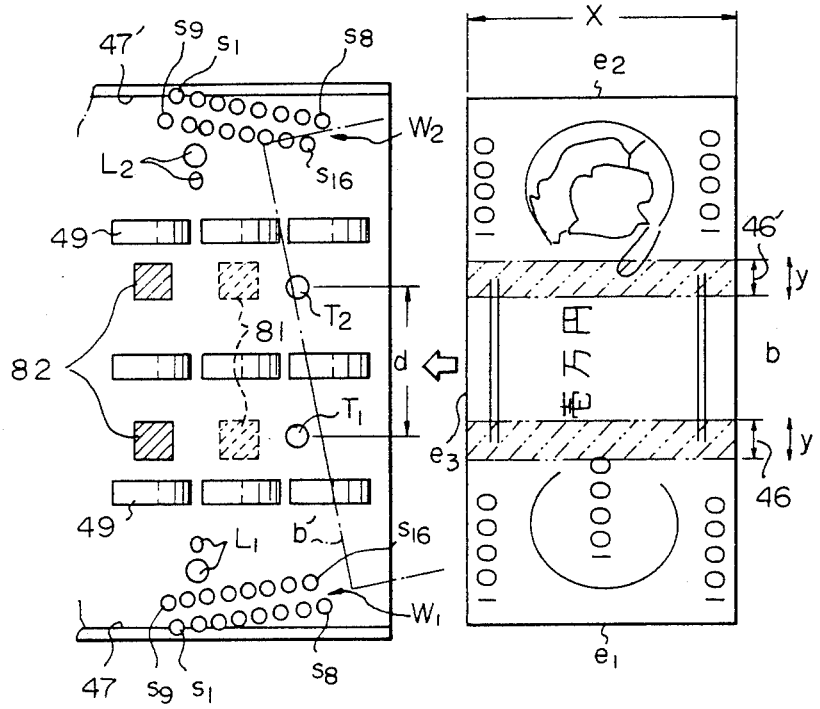
FIG. 5 is a plan view of the bill-discriminating portion used in the apparatus of FIG. 2.

FIG. 5 is an example of a discriminating portion used in a device for discriminating bills according to the present invention. In FIG. 5, reference numeral 49 denotes upper conveyor rollers of the upper side of the passage as shown in FIG. 2, and reference numerals 47, 47' denote paper guides that correspond to guides 47, 47' of FIG. 4. As in the case of FIG. 2, the bill is conveyed by conveyor rollers 27 to a portion between guides 47 and 47' and is then conveyed through the discriminating portion by conveyor rollers 49 and a lower conveyor roller (not shown). The discriminating portion has two lower surface discriminating sensors 81 and two upper surface discriminating sensors 82 which magnetically read patterns on both the front and back surfaces of the bill. Further, two sensors $T_1$ and $T_2$ are arrayed in the widthwise direction of the passage at a distance d so as to detect the amount of tilt. Position sensors $W_1$ and $W_2$ are arrayed along the passage, i.e., on the right and left sides of the discriminating portion through which the bill passes. Position sensors $W_1$ and $W_2$ determine the position of the bill b at both the right and left sides in the widthwise direction of the passage and comprise a plurality of sensor elements s1, s2, . . . that are arrayed a predetermined distance from each other in the widthwise direction of the passage. To more accurately determine the position of the bill, the number of sensor elements s1, s2, . . . should be increased. However, if it is difficult to array sensor elements s1 to s16 in a single row in the widthwise direction of the passage, they can be arrayed in two rows being tilted from the direction of conveyance of the bill as shown in FIG. 5. When bill b passes over position sensors $W_1$, $W_2$, the positions of both edges or ends $e_1$, $e_2$ of the bill and the width of the bill are determined in the discriminating portion depending upon which sensor elements among sensor elements s1, s2, . . . are shielded by ends $e_1$, $e_2$ in the widthwise direction of the bill. The type of bill can be determined by the width of the bill. Therefore, in a case where the apparatus is designed to treat 500 yen to 10;000 yen bills (Japanese monetary units), the distance between outermost sensor elements s1 and s1 of position sensors $W_1$ and $W_2$ is selected to be greater than the lateral size of the 10,000 yen bill, and the distance between innermost sensor elements s16 and s16 of position sensors $W_1$ and $W_2$ is selected to be less than the lateral size of the 500 yen bill. Symbols $L_1$, $L_2$ denote optical discriminating sensors which optically read the patterns of the bill and determine the patterns on the basis of the density of the color component. In the diagrammed embodiment, the light-emitting elements and the light-receiving elements are located above the conveyed bill and utilize the light reflected from the bill. However, the light-emitting elements and the light-receiving elements may be so disposed that light passes therethrough, to detect the pattern utilizing the transmitted light.

Among these sensors, position sensors $W_1$ and $W_2$ and sensors $T_1$ and $T_2$ determine the position of the bill, the amount of tilt of the bill, and the kind of bill, and discriminating sensors 81 and 82 and optical sensors $L_1$ and $L_2$ read the patterns of the bill. The amount of tilt (angle of tilt) of bills delivered one by one is detected on the basis of the time difference in which the position of end $e_3$ of each bill is detected by sensors $T_1$ and $T_2$ which determine the amount of tilt. Sensors $T_1$ and $T_2$ and sensors $L_1$ and $L_2$ are usually disposed within the area of the outermost sensor elements s1 of position sensors $W_1$ and $W_2$.

Figure 6A:
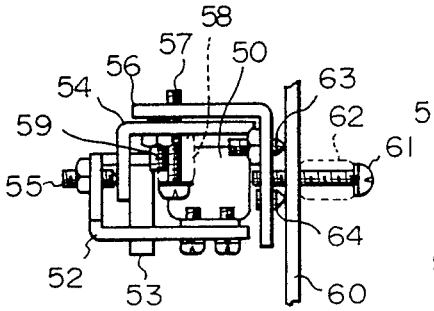
FIGS. 6A and 6B are a plan view and a side view, respectively, of the structure of the magnetic head assembly used in the apparatus of FIG. 2.
Figure 6B:
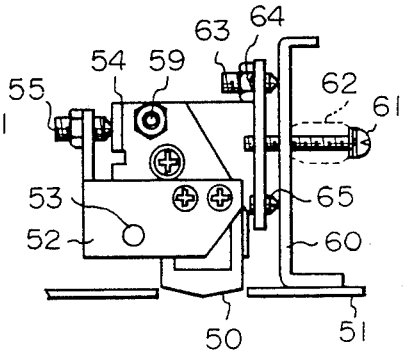

FIG. 6A and FIG. 6B are the structure of a magnetic head assembly used as discriminating sensor 81 or 82. The magnetic head assembly comprises a magnetic head 50, which slightly protrudes from an opening of the guide plate 51 along which a bill is conveyed. Magnetic head 50 is fixed to a first member 52, which slightly revolves around shaft 53 caulked to second member 54. The revolution angle of first member 52 and, therefor, the protrusion of head 50, can be adjusted by screw bolt 55. Second member 54 is joined to third member 56 by screw bolt 57 and coil spring 58 shown by the dotted line. The angle between second member 54 and third member 56 and, therefore, the contact between magnetic head 50 and the bill is adjusted by screw bolt 59 and two screw bolts (not shown) screwed into the second member 54. Third member 56 is attached to a support member 60 by screw bolt 61 and coil spring 62 shown by the dotted line. The angle between the third member 56 and the support member 60 and, therefore, the contact between magnetic head 50 and the bill is adjusted by screw bolts 63, 64, and 65. Support member 60 is fixed to guide plate 51 by spot welding.

Figure 7A:
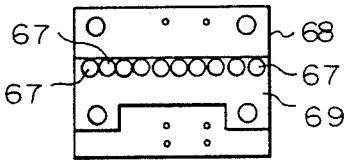
FIGS. 7A through 7C and FIGS. 8A and 8B are schematic views of the structure of the light-emitting unit used in the position sensor of the apparatus of FIG. 2.
Figure 7B:
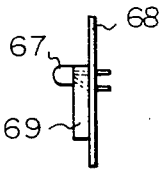
Figure 7C:
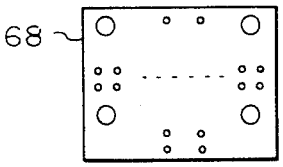
Figure 8A:
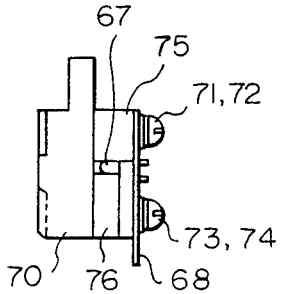
Figure 8B:
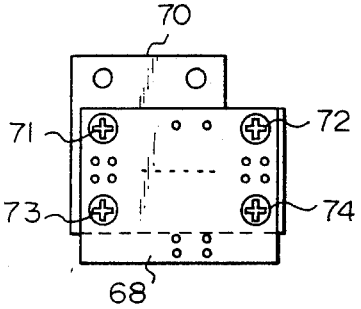

FIGS. 7A through 7C and FIGS. 8A and 8B illustrate the structure of a light-emitting unit used in the aforementioned position sensor $W_1$ or $W_2$. FIGS. 7A through 7C illustrate a sensor board assembly in which a plurality of light-emitting diodes (LED) 67 are attached to a printed circuit board 68 via spacer 69. Spacer 69 is made, for example, of a soft resin so that the position of the each of light-emitting diodes 67 can be adjusted. FIGS. 8A and 8B illustrate a complete light-emitting unit in which the sensor board assembly is attached to a holder member 70, made of a transparent resin, by using four screw bolts 71 through 74. Holding members 75 and 76, which are made of opaque resin, are inserted between holder member 70 and printed circuit board 68 and between the holder member 70 and the spacer 69. Holding members 75 and 76 sandwich light-emitting diodes 67 so that the light-emitting diodes 67 are disposed in a straight line.

Position sensor $W_1$ or $W_2$ is composed of the light-emitting unit mentioned above and a light-receiving unit which has the same structure as the light-emitting unit except that the light-emitting diodes 67 thereof are replaced by photosensitive elements such as photo diodes or photo transistors. The light-emitting unit and the light-receiving unit are disposed on either side of the passage of the bill so that the light-emitting diodes and the light-sensitive elements face each other.

Figure 9A:
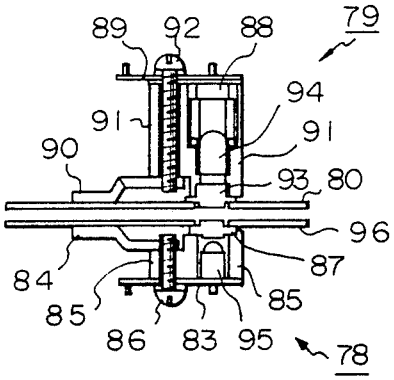
FIGS. 9A and 9B are schematic views of the skew sensor used in the apparatus of FIG. 2.
Figure 9B:
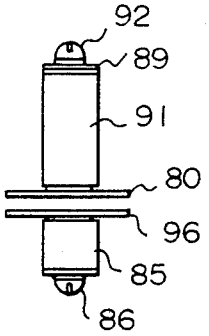

FIGS. 9A and 9B illustrate the structure of the amount-of-tilt sensor T1 or T2, i.e., a skew sensor. The amount-of-tilt sensor of these figures comprises light-emitting unit 78 and light-receiving unit 79 disposed on either side of the passage between the upper guide plate 80 and lower guide plate 96. Light-emitting unit 78 comprises light-emitting diode 95 attached to printed circuit board 83. Printed circuit board 83 is fixed to support member 84 via holder 85 by using screw bolt 86. Support member 84 is welded to lower guide plate 96. Transparent dust cover 87 is inserted between holder 85 and lower guide plate 96. Light-receiving unit 79 comprises a light-sensitive element 88, such as a photo diode, attached to printed circuit board 89, which is fixed to support member 90 via holder 91 by screw bolt 92. Support member 90 is welded to upper guide plate 80. Transparent dust cover 93 is inserted between holder 91 and upper guide plate 80. Light-focusing lens 94 is arranged between dust cover 93 and light-sensitive element 88 and within holder 91.

Figure 10A:
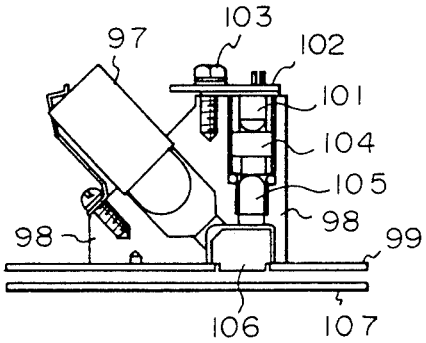
FIGS. 10A and 10B are schematic views of the structure of the reflection-type photo sensor used in the apparatus of FIG. 2.
Figure 10B:
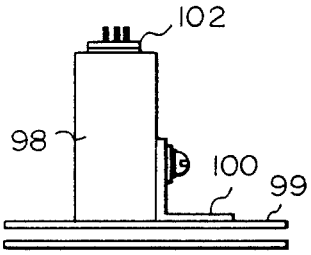

FIGS. 10A and 10B illustrate the structure of a reflection-type photo discriminating sensor $L_1$ or $L_2$. The sensor of these figures comprises lamp 97 as a light-emitting element which is attached aslant to holder 98 fixed to the upper guide plate 99 by support member 100 welded to upper guide plate 99. The sensor also comprises photo diode 101 as a light-receiving element attached to the printed circuit board 102, which is fixed to holder 98 by screw bolt 103. Under the photo diode 101, filter element 104, focusing lens 105, and dust cover 106 made of transparent material, are arranged. Light emitted from lamp 97 is radiated to a bill being conveyed along the passage defined by upper guide plate 99 and lower guide plate 107 through dust cover 106. Light reflected from the bill is received by photo diode 101 through dust cover 106, focusing lens 105, and filter element 104. Filter element 104 attenuates the red component of light reflected from the bill in order to equalize the spectrum distribution of lamp 97.

Figure 11:
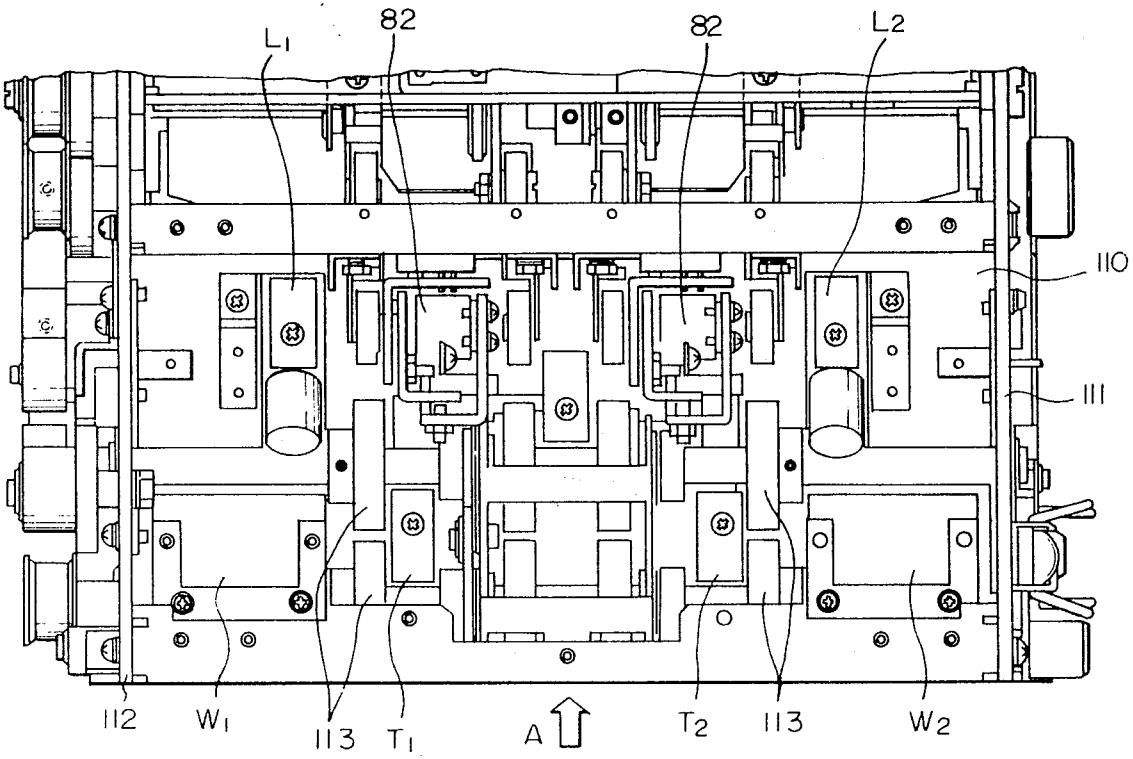
FIG. 11 is a plan view of the structure of the bill-discriminating portion used in the apparatus of FIG. 2.

FIG. 11 is a the detailed structure of the bill-discriminating portion used in a bill-discriminating apparatus according to the present invention. The bill-discriminating portion comprises upper guide plate 110 attached to a pair of side frames 111 and 112 corresponding to guides 47 and 47' of FIG. 5. Magnetic discriminating sensors 82 shown in FIGS. 6A and 6B, photo-discriminating sensors $L_1$ and $L_2$ shown in FIGS. 10A and 10B, and the light-receiving units of position sensors $W_1$ and $W_2$ are attached to upper guide plate 110. Under the light-receiving units of position sensors $W_1$ and $W_2$, the light-emitting units thereof (not shown) are arranged and fixed to the lower guide plate (not shown). The light receiving units of the amount-of-tilt sensors T1 and T2 shown in FIGS. 9A and 9B are attached. Under the light-receiving units of amount-of-tilt sensors T1 and T2, the light-emitting units thereof are arranged and fixed to the lower guide plate. In FIG. 11, a bill is conveyed by conveyor rollers 113 from the direction shown by arrow A to the passage defined by upper guide plate 110 and the lower guide plate, and the position, the amount-of-tilt, and the patterns of the bill are sensed by the above-mentioned various sensors.

While bill b is being conveyed through the thus constructed discriminating portion, the pattern of bill b is read by discriminating sensors 81 and 82. If the regions 46, 46' of the bill indicated by the hatched zones in bill b shown in FIG. 5 pass under discriminating sensors 81 and 82, the data read from the regions is discriminated in relation to reference patterns which have been stored beforehand in the memories. With regard to the lower surface of bill b, furthermore, the patterns are read by lower discriminating sensors 81 and are discriminated in relation to the reference patterns.

The reference patterns are stored in the memory in the form of model maps as shown in FIGS. 12A and 12B. The model map of FIG. 12A corresponds to reading region 46' of FIG. 5, and the model map of FIG. 12B corresponds to reading region 46 of FIG. 5. Model maps are prepared on the basis of data, for example, "1" or "0" obtained in accordance with the patterns of the regions corresponding to reading regions 46, 46' of a real bill. In this case, length X of the bill in the vertical direction is divided into 15 zones in the direction of conveyance as shown in FIGS. 12A and 12B, and the length of reading regions 46, 46' is divided into ten tracks in direction Y (lateral direction of the bill). A total of 150 small sections constitute pattern data that corresponds to the pattern of a real bill and is stored in a memory such as a ROM. Therefore, the data read by discriminating sensor 82 at the side of guide 47 is discriminated in relation to the model map of FIG. 12B, and the data read by discriminating sensor 82 at the side of guide 47' is discriminated in relation to the model map of FIG. 12A.

When bill b is conveyed along the passage, the data need only be discriminated over zones 1 to 15 of a particular track. In practice, however, the bill often becomes tilted, as indicated by dot-dash line b' in FIG. 5. In such an event, the introduced data is compared with the data of small sections in the model map in the tilted direction, as indicated by the chain line, in response to the amount of tilt (angle of tilt). The amount of tilt determined by sensors $T_1$ and $T_2$ and the data related to the position of the bill. The data obtained by sensors $W_1$ and $W_2$ are used for determining the sections from which the reference pattern data is to be read. The reference patterns will also differ, i.e., the contents of the model map will also differ, depending upon the kind of bill. Therefore, the model maps to be used are selected depending upon the size of the bill that is conveyed. For this purpose, size data obtained from sensors $W_1$ and $W_2$ is used.

Figure 13:
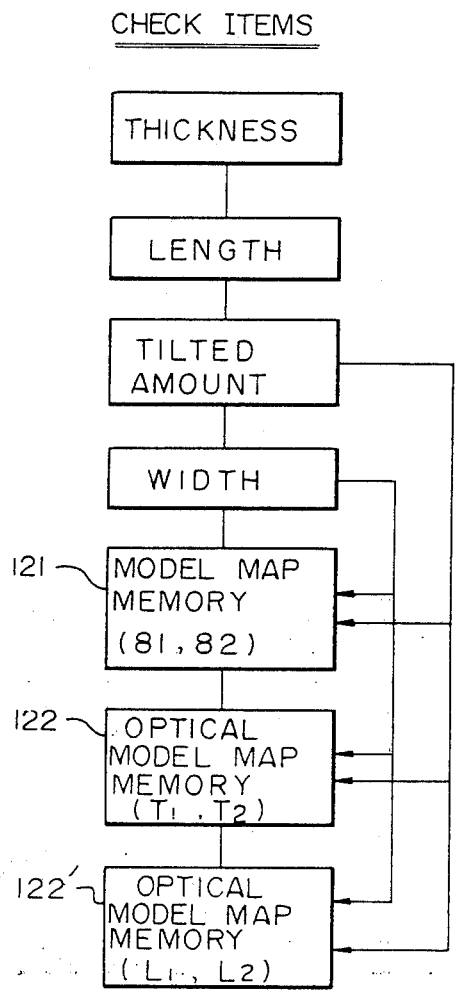
FIGS. 13 and 14 are flow charts of an operation for determining the tracks of model maps.

FIG. 13 is a flow chart which illustrates the operation of selecting small sections of a model map that are to be compared with the data read from the bill. First, as explained above with reference to FIG. 2, the thickness is determined by thickness sensor 35. When it is confirmed that the bill has arrived at sensor $T_1$ or $T_2$, the length of the bill in the direction of conveyance is determined from the time required for the bill to pass between sensors $T_1$ and $T_2$ which are used to detect the amount of tilt. When the length is within the allowable range, the bill is regarded as being real. Thereafter, from the amount of tilt of the bill determined by sensors $T_1$ and $T_2$, the data for correcting the track is sent to model map memory 121 and to optical model map memories 122 and 122'. Model map memory 121 and optical model map memories 122 and 122' are further furnished with data for correcting the track, this data being obtained from the data related to the position of the bill in the widthwise direction of the passage determined by position sensors $W_1$ and $W_2$. The positions of the tracks in the model map are corrected based upon the data related to the position of the bill for correcting the tracks. Optical model may memory 122' stores the model map which is compared with the data read by the reflection-type optical sensors $L_1$ and $L_2$. When optical sensors of the light-transmission type are used, the data is compared with the reference pattern stored in optical model map memory 122.

Figure 14:
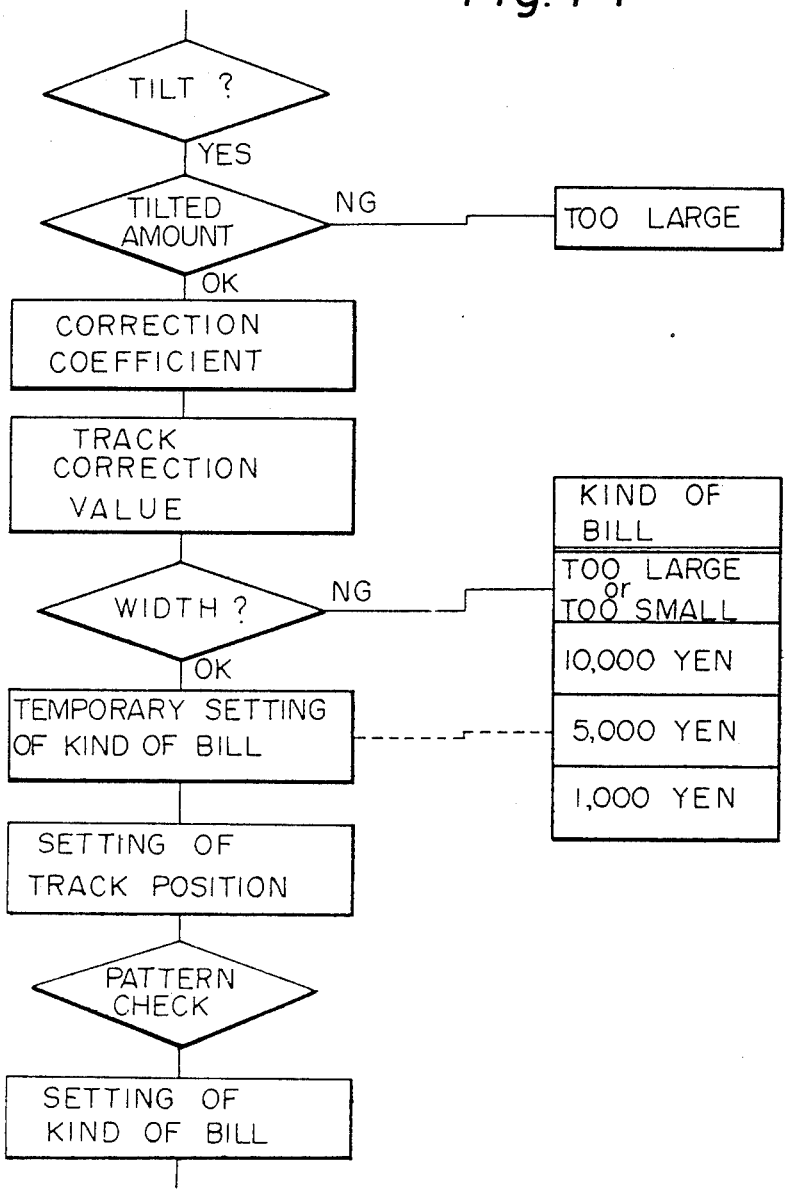

FIG. 14 is a flow chart which illustrates in detail the operation for correcting the track position depending upon the amount of tilt. If the amount of tilt is determined as being too great, the bill is not discriminated and is returned to the return port. If the amount of tilt is within the allowable limit, the correction coefficient is set from the amount of tilt, and the value for correcting the track in the reference pattern in the model map is determined. When the bill tilts as indicated by chain lines b' in FIG. 5, the position of chain line b' and the angle of tilt are determined so as to select small sections in the model map of FIGS. 12A and 12B on the basis of the track-correction value that is set based upon the amount of tilt. The kind of bill is temporarily determined depending upon the size of the bill detected by sensors $W_1$ and $W_2$. In this case, a 10,000 yen bill has the greatest size in the widthwise direction of the passage, and a 500 yen bill has the smallest size in the widthwise direction of the passage. However, when the bill, which has arrived at the discriminating portion, is smaller than the value set for the 500 yen bill or is larger than the value set for the 10,000 yen bill, it is determined as having an improper size and is conveyed to the return port. Depending upon the result of discrimination of the bill in regard to size, the model map of the bill to be used is read out. The position of the track of the model map is then set, and the pattern data read by discriminating sensors 81 and 82 is discriminated in relation to the thus set track. When they appear to be in agreement, the kind of bill is finally determined.

Figures 15, 15A:
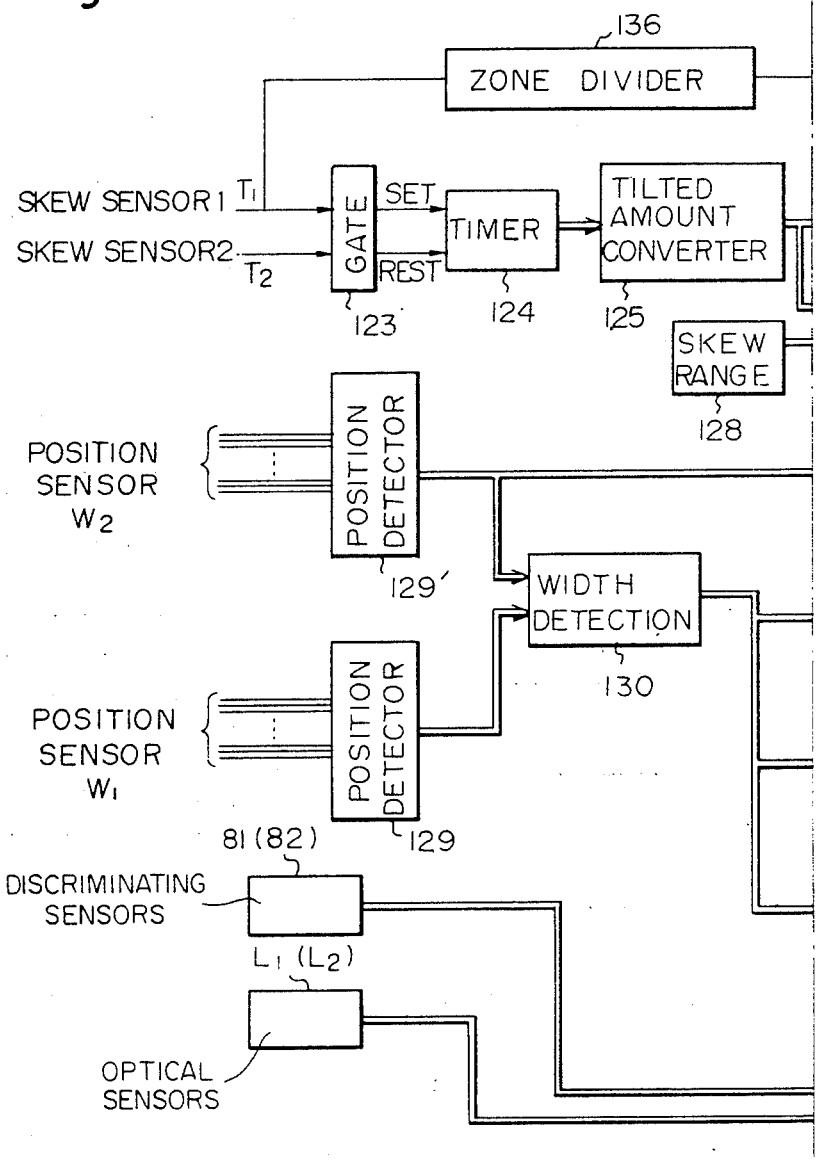
FIGS. 15, 15A and 15B are block circuit diagrams of a discriminating circuit used in the apparatus according to the present invention.
Figure 15B:
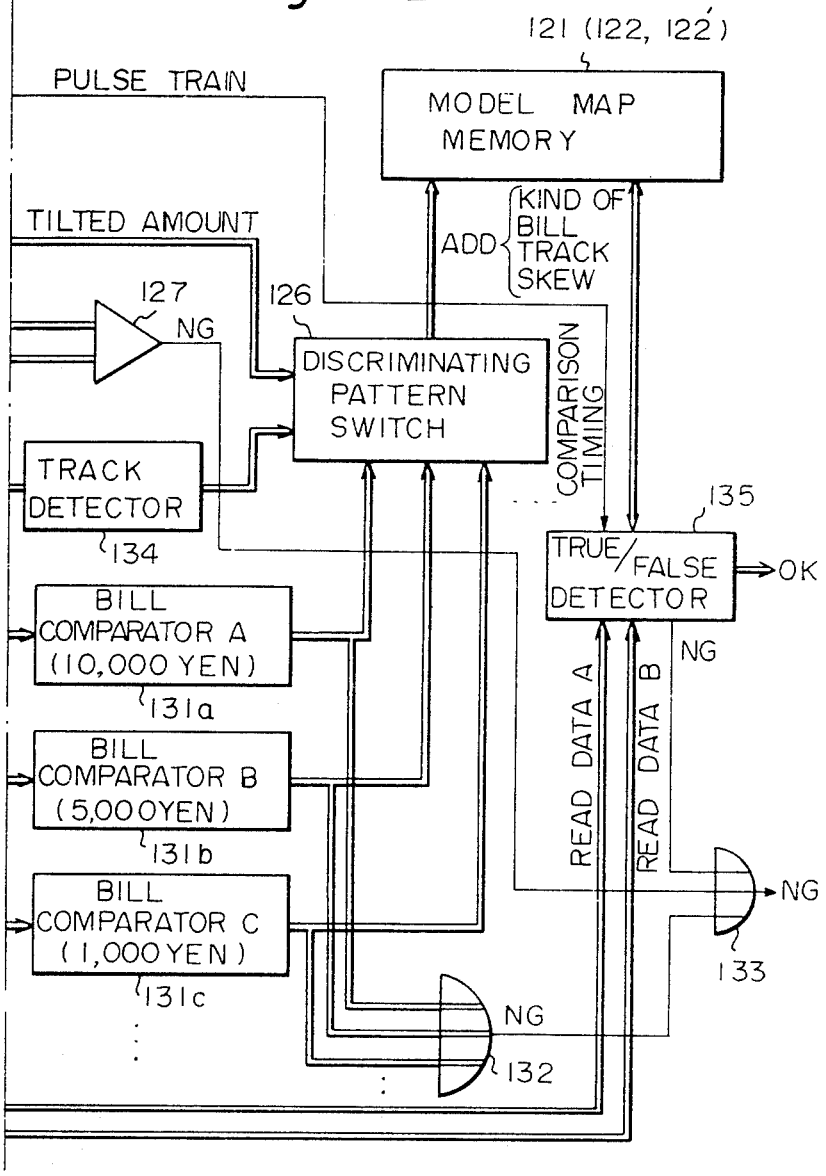
Figure 16:
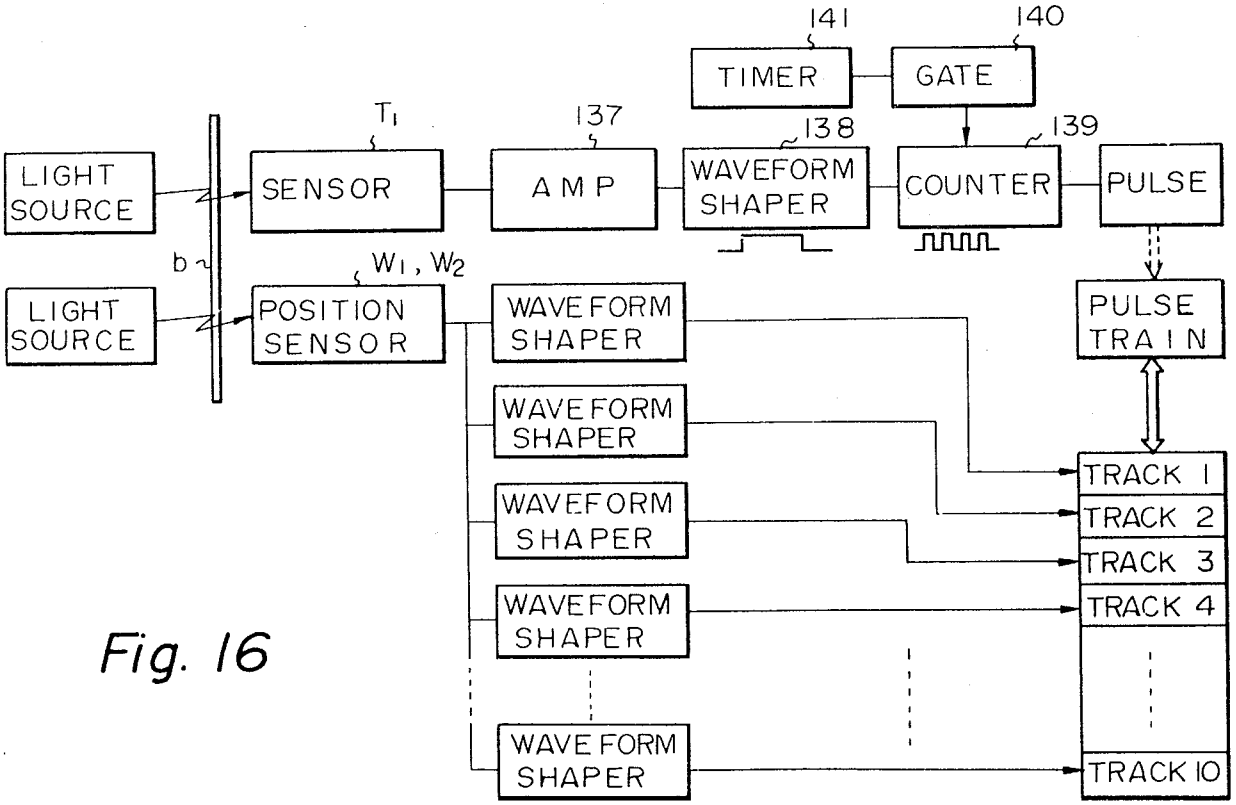
FIG. 16 is a circuit diagram of a zone divider circuit used in the circuit of FIG. 15.

Such processing operation is realized by the processing circuits of FIGS. 15 and 16. In FIG. 15, reference numeral 123 denotes a gate circuit, 124 denotes a timer, 125 denotes a unit for converting the amount of tilt, and 126 denotes a circuit for switching the discriminating pattern. Gate circuit 123 receives discriminating signals when bill edge $e_3$ is detected by sensors $T_1$ and $T_2$, which determine the amount of tilt. Operation of timer 124 is started in response to a signal from either sensor $T_1$ or sensor $T_2$, depending on which one receives the input first, and is stopped in response to a signal from the sensor which later detects the front edge of the bill. The quantity of this time difference is converted into the tilt value (angle of tilt) by unit 125, for converting the amount of tilt, and is sent to a discriminating pattern switching circuit 126. The amount of tilt is also sent to the comparator circuit 127 and is compared with a value set in unit 128 which sets the allowable limit for the amount of tilt. When the set value is exceeded, the bill is determined as being excessively tilted and is returned to the customer.

Position detecting circuits 129 and 129' receive detection signals from sensors $W_1$ and $W_2$. The position of the bill in the widthwise direction of the passage is determined depending on which sensor among sensor elements s1 to s16 in sensors $W_1$ and $W_2$ detects the edge of the bill. Position data is introduced into the width detecting unit 130 to determine the width. The value of the width is then sent to bill comparators 131*a*, 131*b*, 131*c*, . . . to determine the kind of bill. For instance, if the value of the width corresponds to the preset size of the 10,000 yen bill, the bill comparator 131*a* produces a signal which indicates that the bill is a 10,000 yen bill and the signal is then supplied to the discriminating pattern switching circuit 126. When the value of the width does not correspond to any of the preset sizes, signal NG, which indicates an improper size, is produced from gate circuit 133 through gate circuit 132. Further, track detecting circuit 134 receives data from at least one position detecting circuit 129' so as to determine the position of the conveyed bill in relation to discriminating sensors 81 and 82 and $L_1$ and $L_2$. It is then determined which track on the model map should be read out and used. The thus found data is then sent to the discriminating pattern switching circuit 126.

In effect, the discriminating pattern switching circuit 126 is supplied with data relating to the kind of bill, the amount of tilt, and the position of the track. On the basis of this data, therefore, a model map of the corresponding kind of bill is selected from the model map memories provided for all kinds of bills. Then which track of the tracks 1 to 10 in FIGS. 12A and 12B should be read out and used, is specified as address data of the memory. Similarly, the angle of tilt of the lines f in FIGS. 12A and 12B is calculated from the tilt value, and sections, i.e., addresses of the sections traversed by chain line f are specified from the angle of chain line f and from the position of the above-mentioned track. The pattern data of addresses of small sections traversed by chain line f are then sent to a true/false discriminating circuit 135, which is supplied with data read by discriminating sensors 81 and 82 and by optical sensors $L_1$ and $L_2$. The pattern data is compared with a reference pattern introduced from a model map. When the pattern data and the reference pattern are in agreement, the kind of bill temporarily determined by bill comparators 131*a*, 131*b*, . . . is finally determined. Depending upon the degree of contamination of the bill, the pattern data of the addresses traversed by chain line f in the model map may not be completely in agreement. Therefore, if the pattern data of the addresses is in agreement within an allowable limit, the bill is regarded as having been discriminated. When the bill fails to be discriminated, signal NG indicating that the bill is not a real bill is produced by gate 133. In practice, in the case of a 10,000 yen bill, which is the largest in size, the amount of tilt is small, and discrimination is effected within four tracks. As the size of the bill decreases, the amount of tilt increases. Therefore, discrimination is effected within an increased number of tracks. For example, in the case of a 5,000 yen bill, discrimination is effected within eight tracks, and in the case of a 500 yen bill, discrimination is effected within ten tracks.

Reference numeral 136 denotes a zone dividing circuit which divides the time required for sensors $T_1$ and $T_2$ to sense the front and rear edges of the bill into 15 sections in order to divide the data which is read into 15 sections according to the number of zones. That is, as shown in FIG. 16, the signal produced by sensor $T_1$ is amplified through amplifier 137 and is shaped by waveform shaping circuit 138. Then the time through which the wave-shaped signal is produced is equally divided by the counter 139, which performs the counting operation upon receipt of the signals supplied by the timer 141 via the gate circuit 140, thereby obtaining a train of 15 pulses. In this case, if the conveyed bill is a 10,000 yen bill having the greatest size, all of the 15 sections divided from the data are compared with all of the 15 zones in the model map. In the case of a 5,000 yen bill in which the reference pattern has only 14 zones, 14 pulses are produced due to conveyance of the bill and constitute a pulse train. Similarly, 13 pulses are produced in the case of a 1,000 yen bill, and 12 pulses are produced in the case of a 500 yen bill. In the case of a 500 yen bill, which has the smallest size, the pattern is compared over 12 zones. The thus divided pulse trains are supplied in the true/false discriminating circuit 135, whereby the data read out is compared with the pattern data in the model map in the direction of the zones. In a system in which the bill is always guided along a guide of only one side of the passage, the position sensor needs only be provided on one side.

According to the present invention as mentioned above, the position of the bill being conveyed and the amount of tilt are determined to select a model map of a corresponding kind of bill from the memory in which reference pattern data is stored. The data of addresses corresponding to the conveyance condition is read in order to effect discrimination. Therefore, the position of the bill being conveyed, unlike in the conventional art, need not be strictly restricted and the pattern can be discriminated with increased precision even in the case of small size bills. Unlike the conventional art, furthermore, the discriminating sensors need not be installed symmetrically in relation to the center line of the bill. The pattern need not be discriminated for all of the zones in the model map. It need be checked only by selecting and reading a minimum number of addresses based upon the data related to the position of the bill being conveyed and the data related to the amount of tilt. Accordingly, the discriminating time can be greatly reduced, and the discrimination process can be performed at a high speed.

We claim:

1. A bill-discriminating apparatus, including a frame having a slot defining a passage which has an input end through which a bill is conveyed, for discriminating a conveyed bill by comparing patterns read from the bill with standard patterns, said bill discriminating apparatus comprising:

means for reading patterns from the conveyed bill;

one or more sensors, operatively connected to said means for reading patterns, for determining the conveyance condition of the bill;

means, operatively connected to said one or more sensors, for generating the standard patterns corresponding to the conveyance condition of the bill and the denomination of the bill by dividing a predetermined area of the bill into sections, said means comprising:

a model map memory for storing the standard patterns provided by said means for generating the standard patterns; and zone address-selecting means, operatively connected to said model map memory, for supplying address data to said model map memory in order to read out the standard patterns corresponding to the conveyance condition of the bill and denomination of the bill, said zone address-selecting means generating said address data in dependence upon information concerning the conveyance condition of the bill, including the amount of tilt of the bill, information regarding the width of the bill, deviation of the bill in the passage in the direction of a line perpendicular to the direction of the conveyance of the bill, the conveyance speed of the bill, and the denomination of the bill; and means, operatively connected to said means for reading patterns, for comparing the patterns read from the bill with the standard patterns, thereby discriminating the denomination of the bill and whether the bill is real or counterfeit.

2. An apparatus according to claim 1, wherein the apparatus further comprises means, operatively connected to said means for comparing patterns, for temporarily determining the denomination of the bill in accordance with the information concerning the width of the bill and in accordance with said means for comparing the patterns read from the bill with the standard patterns and for determining the bill as being a real bill when the patterns read from the bill coincide with the standard patterns.

3. An apparatus according to claim 2, wherein the apparatus further comprises two skew-sensing means, arranged in the passage in the direction of a line perpendicular to the direction of conveyance of the bill, for determining the amount of tilt of the bill.

4. An apparatus according to claim 2, wherein the apparatus further comprises one or more position sensors, arranged on either side of the passage, for sensing the position of one or more edges of the bill and thereby determining the width of the bill.

5. A bill-discriminating apparatus including a slot defining a passage which has an input end through which a bill is conveyed, for discrimiating the conveyed bill by comparing patterns read from the bill with standard patterns, said bill discriminating apparatus comprising:

means for reading patterns from the conveyed bill;

position sensing means including a plurality of sensor elements, arranged in one or more rows extending at an angle with respect to a line parallel to the direction of conveyance of the bill, for sensing the position of a edge of the bill;

skew sensing means, operatively connected to said position sensing means, for determining the amount of tilt of the bill in the passage, thereby determining the conveyance condition of the bill;

means, operatively connected to said skew sensing means, for generating the standard pattern corresponding to the conveyance condition determined by said skew sensing means and the denomination of the bill; and means, operatively connected to said means for reading patterns, for comparing the patterns read from the bill with the standard patterns, thereby discriminating the denomination of the bill and whether the bill is real or counterfeit.

6. An apparatus according to claim 5, wherein said plurality of sensor elements of said position sensing means are arranged in one or more rows which are substantially perpendicular to the direction of conveyance of the bill.

7. An apparatus according to claim 5, wherein said means for reading patterns is disposed within the passage adjacent to said plurality of sensor elements of said position sensing means and located at a position farthest from the input end of the passage.

8. An apparatus according to claim 6, wherein said means for reading patterns is disposed within the passage adjacent to said plurality of sensor elements of said position sensing means and located at a position farthest from the input end of the passage.

* * * * *